US008661763B2

(12) United States Patent
Oberg

(10) Patent No.: US 8,661,763 B2
(45) Date of Patent: Mar. 4, 2014

(54) PURLIN BRACE SYSTEMS

(76) Inventor: Craig Oberg, Ephraim, UT (US)

( * ) Notice: Subject to any disclaimer, the term of this patent is extended or adjusted under 35 U.S.C. 154(b) by 0 days.

(21) Appl. No.: 13/026,006

(22) Filed: Feb. 11, 2011

(65) Prior Publication Data

US 2011/0197537 A1 Aug. 18, 2011

Related U.S. Application Data

(60) Provisional application No. 61/304,336, filed on Feb. 12, 2010.

(51) Int. Cl.
*E04H 12/00* (2006.01)

(52) U.S. Cl.
USPC ..... 52/650.1; 52/481.1

(58) Field of Classification Search
USPC ..... 52/481.1, 650.1
See application file for complete search history.

(56) References Cited

U.S. PATENT DOCUMENTS

| | | | | | |
|---|---|---|---|---|---|
| 3,778,952 | A | | 12/1973 | Soucy | |
| 3,973,367 | A | * | 8/1976 | Johnson et al. | 52/262 |
| 4,075,807 | A | | 2/1978 | Alderman | |
| 4,379,381 | A | * | 4/1983 | Holcombe | 52/404.3 |
| 4,384,437 | A | | 5/1983 | Coles | |
| 4,408,423 | A | | 10/1983 | Lautensleger et al. | |
| 4,524,554 | A | * | 6/1985 | Simpson | 52/693 |
| 4,566,239 | A | * | 1/1986 | Smigel et al. | 52/407.4 |
| 4,715,156 | A | * | 12/1987 | Dozzo | 52/404.3 |
| 4,840,005 | A | | 6/1989 | Cochrane | |
| 4,875,320 | A | * | 10/1989 | Sparkes | 52/406.1 |
| 5,095,673 | A | * | 3/1992 | Ward | 52/404.2 |
| 5,303,528 | A | * | 4/1994 | Simpson et al. | 52/640 |
| 5,519,978 | A | * | 5/1996 | Sucato et al. | 52/481.1 |
| 5,647,175 | A | | 7/1997 | Smyth | |
| 5,799,461 | A | * | 9/1998 | Dittemore | 52/588.1 |
| 2008/0282635 | A1 | | 11/2008 | Robinson et al. | |

FOREIGN PATENT DOCUMENTS

| | | |
|---|---|---|
| GB | 2033948 | 8/1979 |
| JP | 2003321895 | 11/2003 |

* cited by examiner

*Primary Examiner* — Mark Wendell
(74) *Attorney, Agent, or Firm* — Thorpe North & Western LLP

(57) ABSTRACT

A purlin brace system for roof decks which can be used to provide additional lateral support to roofs is set forth. The system includes a plurality of purlins, each purlin including a central support and a bottom flange. The plurality of purlins are oriented to form a parallel array of purlins such that voids exist between the purlins in the parallel array. The bottom flanges of the purlins define a lower plane. The system further includes at least one brace oriented transverse to the plurality of purlins. The at least one brace has a span member transverse to a purlin axis. The at least one brace is attached to a vertical plate which is cantilevered such that the vertical plate extends away from the span member and along the central support to resist rotational movement of a corresponding purlin.

24 Claims, 4 Drawing Sheets

PURLIN BRACE SYSTEMS

RELATED APPLICATIONS

This application claims the benefit of U.S. Provisional Application No. 61/304,336, filed Feb. 12, 2010 and U.S. Non-provisional application Ser. No. 12/899,399, filed Oct. 6, 2010, each of which is incorporated herein by reference.

FIELD OF THE INVENTION

The present invention relates generally to metal roofing systems and associated methods. Accordingly, the invention involves the fields of construction and mechanical engineering.

BACKGROUND

Metal roofs are well known and have been used for many years in commercial and industrial-type buildings. Typically, such roofs are constructed of parallel spaced joists or purlins over which are placed the various other components of the roof, including the metal roof deck. As energy efficiency standards have increased, new government requirements have forced metal roof manufacturers and installers to increase the amounts, types, and location of insulation used in the roofs, including the requirement of placing a thermal insulation block between the metal purlin and the metal roof deck. Unfortunately, some new insulation requirements can weaken or lessen the lateral strength of the roof deck. Accordingly, research continues into roofing reinforcement systems to improve the structural integrity of insulated roofing systems that have reduced lateral strength.

SUMMARY

A purlin brace system for roof decks is provided, which can be used to provide additional lateral support to roofs. In one aspect, the system can include a plurality of purlins, each purlin including a central support (i.e. purlin web) and a bottom flange. The plurality of purlins can be oriented to form a parallel array of purlins such that voids exist between the purlins in the parallel array. The bottom flanges define a lower plane. The system can also comprise at least one brace oriented transverse to the plurality of purlins. The brace can have a span member transverse to a purlin axis and attached to a vertical plate, which can be cantilevered such that the vertical plate extends away from the span member and along the central support to resist rotational movement of a corresponding purlin.

In one aspect, the purlins can be Z-purlins. In another aspect, the purlins can be metal purlins. In a yet another aspect, the voids can be substantially uninterrupted along the purlin axis. In still another aspect, the system can further comprise insulation disposed within the voids. In a particular aspect, the insulation can be substantially continuous along the purlin axis.

In one aspect, the at least one brace can be secured to at least one of the plurality of purlins along the central support via the vertical plate. In another aspect, the at least one brace can be secured to at least one of the plurality of purlins along the bottom flange via the span member. In a yet another aspect, the at least one brace can be secured to at least one of the plurality of purlins along an upper flange. In still another aspect, the at least one brace can span at least three purlins.

In a further aspect, the span member can be disposed below the lower plane. In a particular aspect, the at least one brace can further comprise a spacer member oriented to contact the bottom flange and maintain a gap between the bottom flange and the span member. In one aspect, the span member can be disposed above the lower plane adjacent the bottom flange or adjacent an upper flange of the purlin. In a particular aspect, the system can further comprise a facing member attached to the parallel array of purlins along the lower plane. In one aspect, the span member can be a rectangular bar, angle, channel, or T-bar. In a particular aspect, the span member can be a rectangular bar.

In one aspect, the vertical plate can be attached to the span member via a welded joint. In another aspect, the vertical plate can be attached to the span member via an adjustable threaded engagement. In a yet another aspect, the vertical plate can include a slot configured to receive the span member which is attached therein. In still another aspect, the vertical plate can extend past the span member an extension distance from two to eight times a width of the span member. In a further aspect, the span member, vertical plate and purlin axes are each orthogonal to the other.

In still a further aspect, the system can further comprise a plurality of metal roof panels, each panel being configured to be attached to an upper flange of the metal purlins to form a roof deck. In a particular aspect, the system can further comprise a plurality of thermal insulation blocks, each thermal insulation block being disposed between the metal purlin and the metal roof panel. In a more particular aspect, the system can further comprise a cleat disposed between the thermal insulation block and the metal roof panel, wherein the cleat includes a protrusion which secures the thermal insulation block and inhibits lateral movement between the thermal insulation block and the cleat.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
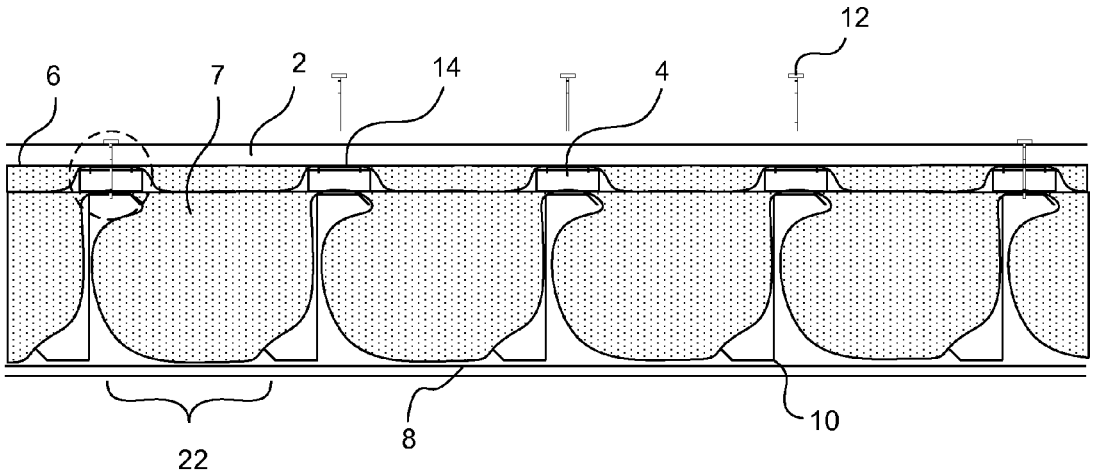
FIG. 1 is a cross-sectional view of an installed insulated roof.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a purlin" includes one or more of such purlins and reference to "a thermal insulation block" includes reference to one or more of such blocks.

Definitions

In describing and claiming the present invention, the following terminology will be used in accordance with the definitions set forth below.

As used herein, the term "threaded fastener" refers to any fastening device or combination of devices which incorporates an at least partially threaded cylinder as a component of the device. Non-limiting examples of such devices include screws, bolts, and the like. Typically, self-tapping metal screws are used in connection with the present invention.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

A system and related method for installing and insulating metal roofs is provided. An example of a metal roof is illustrated in FIG. 1, which shows one embodiment of an insulated roof deck system and includes metal purlins 10, metal roof panels 2, thermal insulation blocks 4, cleats 14, threaded fasteners 12, and insulation 6. The metal purlins 10 are configured to be arranged in a parallel or substantially parallel array such as shown in FIG. 1. When the purlins are disposed in the parallel array, voids or spaces 22 exist between the purlins. The purlins used in the systems and methods of the invention can be made of any metal or metal alloy including but not limited to steel, alloys of steel, aluminum, and others. The purlins can take any form known in the art including, but not limited to, I-beams, Z-shaped (shown in FIG. 1), C-shaped, tubular, or boxed purlins. As is known in the art, the purlins form the primary structural support for the roof structure. As such the purlins are typically attached to a vertical support, e.g. side walls and/or center supports.

The metal roof panels 2 can form the outer roof deck of the roofs made using the methods and systems of the present invention. As with the purlins 10, the metal roof panels can be made of any metal or metal alloy known in the art, including but not limited to steel, alloys of steel, aluminum, tin, and the like. The metal roof panels can be interlocking, corrugated, or of any other design or configuration known in the art. The type and thickness of the metal roof panels can vary depending on the intended use. In one option, the metal roof panels can be corrugated 26 gauge metal. When installed, the metal roof panels 2 can be attached to the metal purlin by threaded fasteners 12.

In the systems of the present invention, the thermal insulation blocks can be disposed between the metal roof panel 2 and the metal purlin 10 so as to reduce or substantially prevent the transfer of heat between the metal roof panel 2 and the metal purlin 10. The thermal insulation blocks 4 can be made of any insulative material known in the art including, but not limited to polystyrene, polyisocyanurate, polyurethane, mixtures thereof, and the like. The thermal insulation blocks 4 can be any size or shape so long as they form an insulative layer between the metal roof panels 2 and the metal purlins 10. Typically, the insulation block can be an elongated block which substantially coincides with a longitudinal upper surface of the metal purlin.

In one embodiment, the system can optionally include an adhesive layer disposed between the thermal insulation block 4 and the cleat 14, the thermal insulation block 4 and the metal purlin 10, or both. The adhesive layer facilitates the construction or assembly of the insulated roof. For example, when the adhesive layer is present between the thermal insulation block and the metal purlin, the thermal insulation block is held in place with respect to the metal purlin until the entire system can be secured using the threaded fasteners 12.

Figure 2:
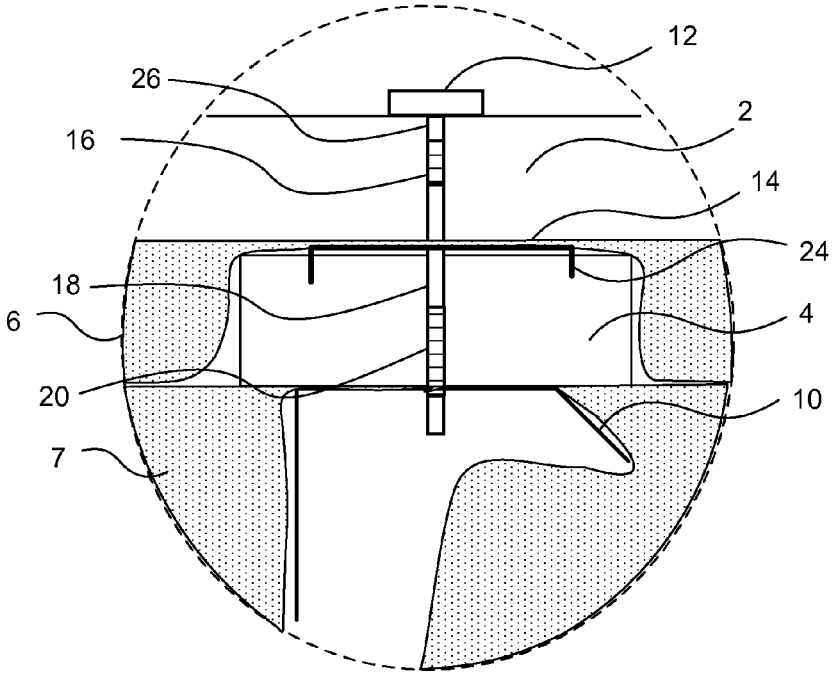
FIG. 2 is a blown-up view of the outlined corresponding region of FIG. 1.

In order to reduce or prevent lateral movement between the metal roof panel 2 and the thermal insulation block 4, the systems of the present invention can include cleats 14, which can be disposed between the thermal insulation block 4 and the metal roof panel 2. FIG. 2 shows an exploded view of the dashed region in FIG. 1 and illustrates in greater detail one embodiment of the cleat 14 and its relationship to the other components in the system. The cleats 14 can have a protrusion 24, or multiple protrusions, which are configured to secure the thermal insulation block 4 when placed in contact therewith. In the embodiment shown in FIG. 2, the protrusion 24 on the cleat secures the thermal insulation block by penetrating the block. This is an example of a penetrating protrusion. These protrusions engage the insulation block sufficient to reduce lateral or offset movement between the metal roof panel and the metal purlins.

The cleats 14 can come in a variety of shapes and sizes and can be made of any material so long as the material is sufficiently rigid and strong to inhibit lateral movement of the thermal insulation block 4 or between the thermal insulation block and the metal roof panel 2 when the cleat is installed. In one embodiment, the cleat can be made from a metal. In another embodiment, the cleat can be a U-shaped piece of metal, with the protrusions corresponding to the two ends of the "U." In this embodiment, when the U-shaped cleat 14 is inverted, the two ends or protrusions 24 can penetrate the thermal insulation block 4 and inhibit lateral movement of the block, or between the block and the metal roof panels 2. In one embodiment, the protrusions on the cleat can be serrated to facilitate embedding the edges into the block. In each case, the cleats and blocks extend substantially the length of the purlin to which they are attached. This can be accomplished using a single block-cleat assembly or multiple such assemblies oriented in series to achieve the desired length.

Figure 3:
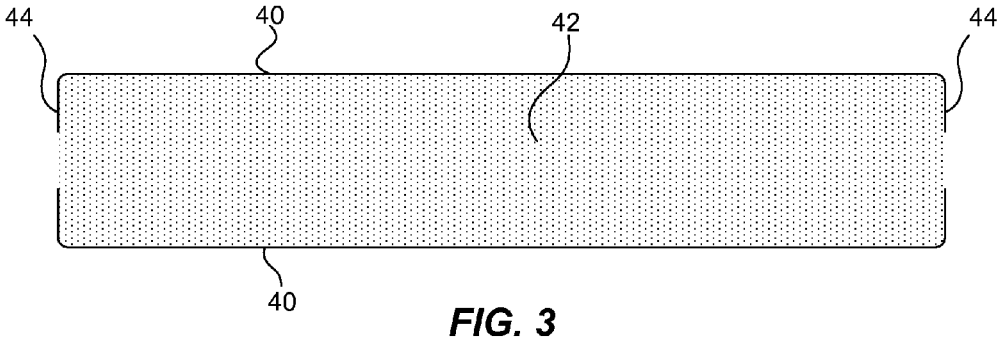
FIG. 3 is a cross-sectional side view of one embodiment of a cleat and thermal insulation block.

FIG. 3 shows an alternative cleat-block assembly which can be used in the systems of the present invention. Specifically, FIG. 3 shows an embodiment in which metal cleats 40 cap opposing sides of a thermal insulation block 42, effectively sandwiching the thermal insulation block. Like the metal cleat of FIG. 2, the metal cleats shown in FIG. 3 include protrusions 44 which secure the thermal insulation block against lateral movement. The protrusions of the embodiment shown in FIG. 3 secure the thermal insulation block by confining the block between the protrusions. This is an example of confining protrusions. Like the penetrating protrusions discussed above, the confining protrusions engage the insulation block sufficient to reduce lateral or offset movement between the metal roof panel and the metal purlins.

It is noteworthy that, although the cap-style cleats may be used in pairs (e.g. FIG. 3), such pairing of the cleats is not required. Although not shown, in one embodiment, the cleat can include both penetrating protrusions and confining protrusions. In another embodiment, the system can include one cleat with penetrating protrusions and one cleat with confining protrusions.

A thermal insulation block and cleat assembly can be manufactured independently and combined together during construction of the roofing system. Alternatively, a thermal insulation block and cleat can be manufactured together and included as an integrated component in the roofing systems. For example, a pair of cleats can be spaced apart and oriented relative to one another as desired in a final assembly. An insulating precursor material can be blow molded or otherwise injected into the space between the cleats. Optional adhesive layers can be formed to secure the insulation against the cleats, depending on the inherent cohesiveness between the materials. During molding, a plastic film can be oriented across an outer side space between opposing protrusions to prevent insulation flowing outside of the assembly. Alternatively, excess insulation can be sliced from the sides, e.g. using a heated wire, blade or saw. Generally, any manufacturing process known in the art can be used so long as the resultant thermal insulation block and cleat integrated component can perform the desired function of insulating the purlins against thermal transfer.

When installed, the roofing systems of the present invention can optionally include insulation layers between the metal roof panels and the cleats. Such insulation can be standard 2-4 inch insulation. During assembly, insulation areas between the roof panels and cleats may be pinched and compressed ⅜ inch or less.

Referring again to FIG. 1, the voids 22 between the metal purlins 10 can be filled with insulation 6, 7. The insulation can be any type of insulation known in the art such as fiberglass. Advantageously, the insulation can be provided in two layers. A first insulation layer 6 can be disposed between the plurality of metal roof panels 2 and the plurality of thermal insulation blocks 4. A second insulation layer 7 can be disposed between the plurality of thermal insulation blocks 4 and the plurality of metal purlins 10. In one aspect, the second insulation layer can have an expanded portion which at least partially fills the voids. The combination of the first and second insulation layer can dramatically increase the insulation level of the system. Each of the insulation layers can be formed of compressible insulation. Although other sizes can be used, 2 inch to 4 inch insulation layers is most common. In one aspect, the combined uncompressed width of the first and second insulation layers can be about 6 inches. In these 6 inch cases, R-values from about 22 to about 26 can be achieved. Furthermore, providing insulation layers both above and below the thermal insulation blocks has the unexpected effect of increasing shear load and stiffness of the system.

The second insulation layer 7 can optionally be supported by support rails 8. The support rails can be configured to span the voids between the metal purlins 10 and can be secured to the metal purlins. The support rails can also add to the structural support of the roof system and typically run substantially perpendicular to the purlins. Alternatively, the second insulation layer can have facing tabs which are guided under the lower flange of the purlin. In this way, the percentage fill of the void space 22 can be increased.

The components of the insulated metal roofs made from the systems and methods of the present invention can be secured together using fasteners 12. Specifically, the fasteners used in the system are configured to secure the metal roof panel 2, the cleat 14, and the thermal insulation block 4 to the metal purlin 10. Generally, any type of fastener such as a threaded fastener or threaded fastener system can be used. Non-limiting examples include screws and bolts, although other mechanisms such as rivets, clips, or the like can be suitable.

Because the thermal insulation block 4 can be relatively soft, over-tightening of the threaded fasteners can cause the thermal insulation block to become completely or partially crushed, thereby reducing the insulative value provided by the thermal insulation block. Similarly, insulation which is placed between the roof panels 2 and the cleats 14 can be pulled up through the roof panel by fastener threads if over-tightened. In order to prevent over-tightening of the threaded fastener 12, in one embodiment, the threaded fastener 12 can have a first threaded region 20 and a second threaded region 16 which are separated by an unthreaded region 18 (See FIG. 2). In one aspect, the length of the unthreaded region 18 of the threaded fastener 12 can correspond to the thickness of the thermal insulation block. The position of the fastener 12 is shown partially engaged. Thus, the system can be assembled such that the threaded fastener is disposed with the unthreaded region substantially located within the thermal insulation block.

The threaded fastener 12 can optionally include a second unthreaded region 26 proximate the fastener head. The length of this second unthreaded region can correspond to a minimum desired thickness of the roof panel and pinched insulation combined, including optional washers. In this way, splaying of the roof panel metal immediately around the fastener shaft can be reduced or eliminated while also avoiding pulling insulation up through the roof panel.

All embodiments of the systems of the present invention can be used in accordance with the related method. In one embodiment, a method of installing an insulated metal roof is provided which includes the steps of arranging a plurality of metal purlins in a substantially parallel configuration such that voids exist between the metal purlins, disposing a thermal insulation block on top of the metal purlin, disposing a cleat on top of the thermal insulation block, disposing a metal roof panel on top of the cleat, and securing metal roof panel, cleat, and thermal insulation block to the metal purlin with a threaded fastener. The cleat used in the method has a protrusion which secures the thermal insulation block and inhibits lateral movement between the thermal insulation block and the cleat. Optional support rails 8 can be mounted substantially perpendicular the purlins 10 spanning the spaces 22. The steps can be performed in the order set forth above, although assembly can occur in various sequences. Furthermore, optional insulation layers can be oriented and laid between the roof panels and the optional support rails.

Figure 4A:
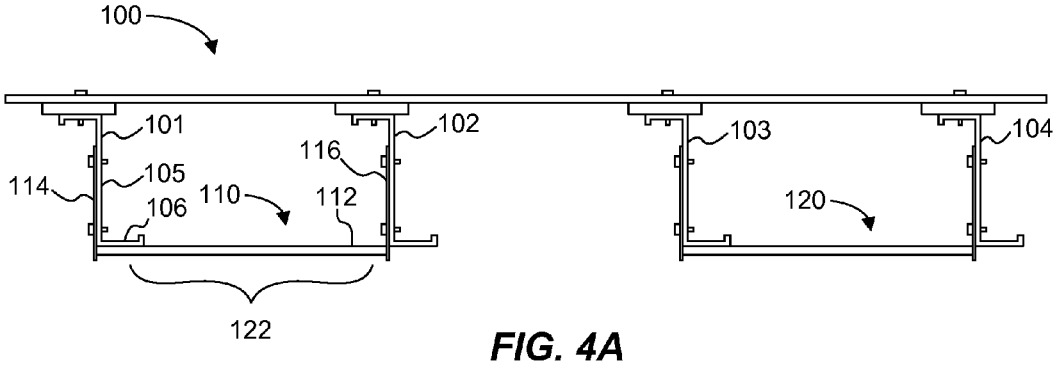
FIG. 4A is a side cross-sectional view of a purlin brace system along a roof deck system.
Figure 4B:
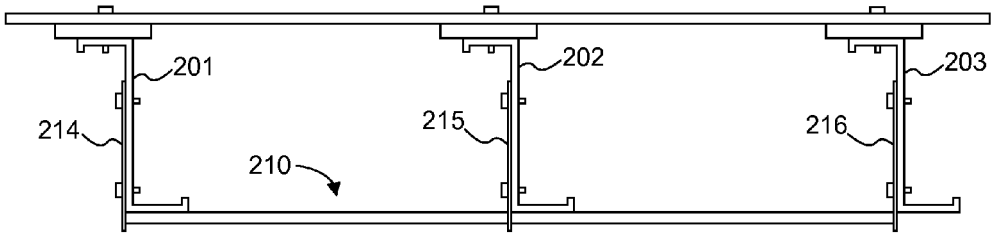
FIG. 4B is a side cross-sectional view of another example of a purlin brace system along a roof deck system.
Figure 4C:
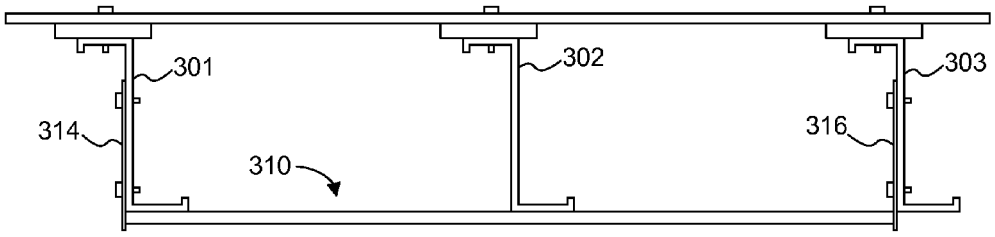
FIG. 4C is a side cross-sectional view of yet another example of a purlin brace system along a roof deck system.

Roof deck systems, including embodiments of the insulated roof deck system discussed herein, may be strengthened by utilizing a purlin brace system. FIGS. 4A-4C illustrate several purlin brace systems that can be incorporated with insulated roof deck systems. As shown in FIG. 4A, a purlin brace system 100 may comprise a plurality of purlins 101, 102, 103, 104. Each purlin may include a central support 112 and a bottom flange 106. The plurality of purlins in the brace system may be oriented to form a parallel array of purlins such that voids 122 may exist between the purlins in the parallel array. In certain embodiments, the voids may be substantially uninterrupted along the purlin axis. The view of FIGS. 4A-4C is parallel to the purlin axis. The voids, for example, may be free of common roofing or ceiling apparatus that can extend into a space between purlins, such as insulation, structural supports, HVAC ducting, wiring, pipes, hoses, etc. However, in some aspects, such features can be present in the voids. In another embodiment, the purlin brace system may further comprise insulation oriented within the voids (see FIG. 1). In an aspect of this embodiment, the insulation may be substantially continuous along the purlin axis.

The purlin brace system may further comprise at least one brace 110. The brace may be oriented transverse to the plurality of purlins, which are arranged in a parallel array, as discussed above. The brace may have a span member 112 that spans across a void 122 created by at least two parallel purlins 101, 102 in the array. To provide support, the span member may be attached to a vertical plate 114, 116. The attachment of the vertical plate to the span member may be configured as a cantilever, discussed in more detail below with reference to FIGS. 5A-6H. The cantilever configuration, for example, may be such that the vertical plate 114 extends away from the span member 112, which may be transverse to a purlin axis, and along the central support 105 of a purlin 101 in the purlin array. Thus, the cantilever configuration may resist rotational movement of the purlin. In certain embodiments, the span member 112, vertical plate 114, and purlin axes may each be orthogonal to the other.

The purlin brace discussed above may provide support for a variety of purlin configurations such as, but not limited to, Z-purlins, channel, T-shape, rectangular, I-beam, and the like. Moreover, the purlin brace may provide support for purlins constructed of materials such as, but not limited to, metal, wood, polymer, or composites thereof.

FIG. 4A further illustrates that the purlin brace system 100 can include an additional purlin brace 120. In this example, the purlin brace 120 spans between purlins 103 and 104. Although not shown, in another aspect, a purlin brace can also span between purlins 102 and 103. It is to be understood that there can be any number of purlin braces disposed along a purlin axis to span between any of the purlins 101, 102, 103, 104.

Although FIG. 4A illustrates that the braces 110 and 120 may span two purlins in the purlin array, a brace may span more than two purlins. In some embodiments, for example as shown in FIGS. 4B and 4C, a purlin brace may span three or more purlins in the purlin array. In FIG. 4B, for example, purlin brace 210 spans three purlins 201, 202, and 203 and is attached to each of the three purlins by vertical plates 214, 215, and 216, respectively. Thus, a brace can be attached to every purlin that is spanned by the brace. In another aspect, in FIG. 4C, purlin brace 310 spans three purlins 301, 302, and 303, but is only attached to two purlins 301 and 303 by vertical plates 314 and 316, respectively. Thus, a purlin brace can be attached to selected purlins spanned by the brace.

Figure 5A:
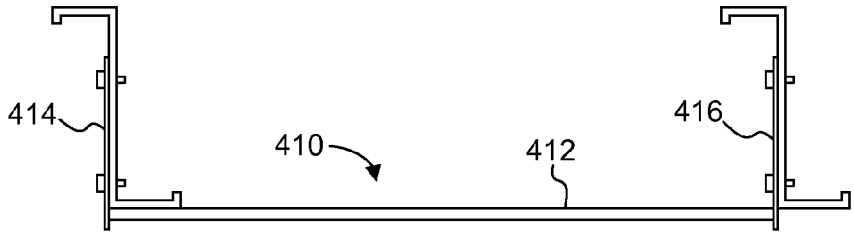
FIG. 5A is a cross-sectional view of an example of a purlin brace system.
Figure 5B:
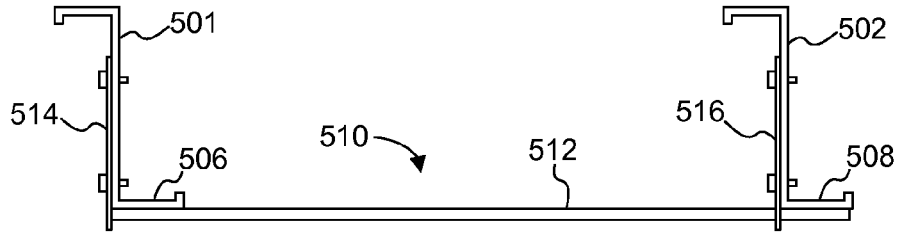
FIG. 5B is a cross-sectional view of another example of a purlin brace system.

Referring now to FIGS. 5A-5D, illustrated are several embodiments of a purlin brace system. FIGS. 5A and 5B, illustrate that a vertical plate may be attached to a span member via a welded joint. For example, in FIG. 5A, purlin brace 410 includes span member 412 that is attached to vertical plates 414 and 416 by welded joints. In this example, the span member terminates at the vertical plate. This can be accomplished by butting the span member against the vertical plate or by inserting the span member into an opening of the vertical plate, but not extending the span member through the opening such that it extends beyond the vertical plate.

FIG. 5B also illustrates welded joints. Specifically, purlin brace 510 includes span member 512 that is attached to vertical plates 514 and 516 by welded joints. In this example, however, the span member 512 extends beyond the vertical plate 516 along a bottom flange 508 of purlin 502. Such an extension may provide additional stability for the interface of the purlin brace 510 and purlin 502, as compared to the configuration illustrated in FIG. 5A. The span member may extend beyond the vertical plate by, for example, extending through an opening in the vertical plate. In another aspect, the purlin brace of FIG. 5A can be modified by welding or otherwise attaching an extension piece to the other side of the vertical plate, opposite the span member, such that the resulting structure resembles the purlin brace of FIG. 5B.

Figure 5C:
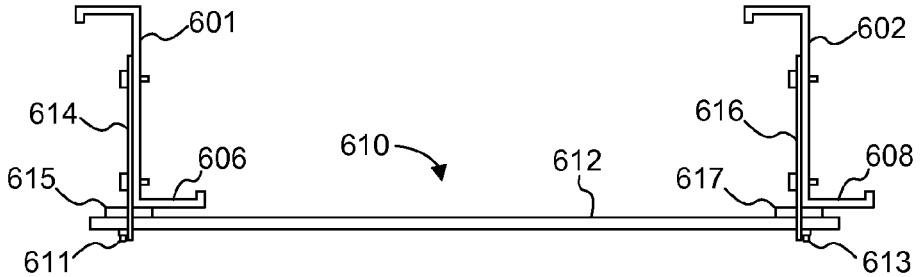
FIG. 5C is a cross-sectional view of yet another example of a purlin brace system having a spacer between the strut and bottom flange.

In another aspect, FIG. 5C illustrates that vertical plates 614 and 616 may be attached to a span member 612 via an adjustable threaded engagement 611, 613. In an aspect of this embodiment, discussed in more detail below, the vertical plate may include a slot configured to receive the span member that is attached via the threaded engagement. Thus, the vertical plates 614, 616 may be positioned along the span member 612 to line up with a corresponding purlin 601, 602. A purlin brace may further comprise a spacer member 615, 617 oriented to contact a bottom flange 606, 608 and maintain a gap between the bottom flange and the span member 612. In certain embodiments, the spacer member may be welded to the vertical plate. Thus, the spacer member 615, 617 may provide increased resistance to forces that would tend to apply a moment to the cantilevered attachment of the vertical plate and the span member and can increase the effectiveness of the threaded engagement.

Although not illustrated, it should be recognized that structural supports, in addition or as an alternative to the spacer member, may be present to increase or improve the structural integrity of the cantilevered connection between the purlin brace and the vertical plate. For example, a bracket may be welded or bolted to the vertical plate and/or the span member to improve or strengthen the connection. Such additional structural supports can be utilized with either a welded or a bolted/threaded connection between a span member and a vertical plate. Such brackets may be oriented opposite the bottom flanges, and secured along a top surface of the span member adjacent the vertical plates and a lower portion of the purlin web.

Figure 5D:
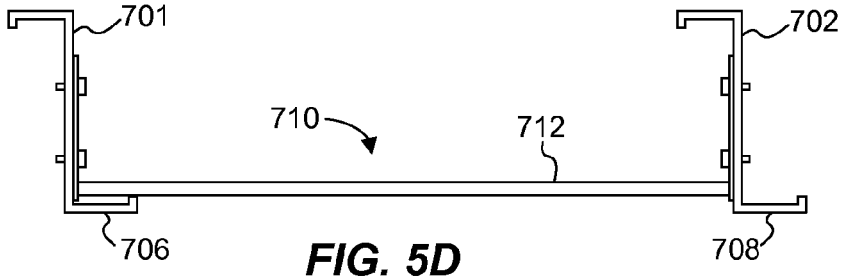
FIG. 5D is a cross-sectional view of still another example of a purlin brace system having a strut on top of the bottom flange.

In one aspect of a purlin brace system, the bottom flanges of the array of purlins may define a lower plane. As illustrated in FIGS. 5A, 5B, and 5C, the span members 412, 512, 612 may be disposed below the lower plane defined by the bottom flanges of the purlins. On the other hand, FIG. 5D shows that a span member 712 may be disposed above a lower plane of bottom flanges 706, 708 of purlins 701, 702. In this case, the span member 712 is adjacent the bottom flange 706, 708. However, the span member can be adjacent an upper flange of the purlin or disposed anywhere in between an upper and a lower flange. This embodiment may be useful when retrofitting purlin braces to a pre-existing roof deck system to avoid interference with structure that may be below the lower flanges of the purlins.

As discussed above in reference to FIGS. 5A-5D, a purlin brace may be secured to at least one of the plurality of purlins along the central support via the vertical plate. On the other hand, a brace may be secured to at least one of the plurality of purlins along the bottom flange via the span member. For example, in FIG. 5B, the span member 512 can be attached to bottom flanges 506, 508, instead of the attachment of vertical plates 514, 516 to central portions of purlins 501, 502. In this example, the cantilevered connection of the vertical plates and the span member allows the vertical plates to contribute structural support to the purlin brace even though there is no direct attachment between the vertical plates and the purlin. Of course, both the vertical plates and the span member can be attached to the purlins, as desired.

In certain embodiments, the purlin brace system may further comprise a facing member (not shown) attached to the parallel array of purlins along the lower plane. A facing member may be a covering, such as a ceiling, to shield the roofing components from view as seen from below. In a particular embodiment, the facing member may be a cosmetically appealing vinyl panel.

Although not shown in the figures, a purlin brace may be secured to at least one of the plurality of purlins in the purlin array along an upper flange. For example, a purlin brace may be inverted (relative to the figures) such that the span member is located near the top flange of a purlin. In one embodiment, the span member may be below a plane defined by the top flanges of the array of purlins. In this embodiment, the vertical plates may be secured to the purlins in a manner similar to that illustrated in FIG. 5D. Alternatively, the span member may be above the plane defined by the top flanges of the array of purlins. In this embodiment, the purlin brace may be secured to the purlins in the purlin array in any manner illustrated in FIG. 5A, 5B, or 5C.

With reference to FIGS. 6A-6H, illustrated are several examples of vertical plate and span member configurations. FIGS. 6A-6D illustrate various span member cross-sections in a welded attachment to a vertical plate. Although the span member cross-sections are shown in particular orientations by way of example, it should be understood that the span members can be oriented relative to the vertical plate in any suitable manner in accordance with the present disclosure.

Figure 6A:
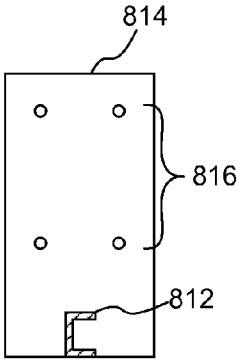
FIG. 6A is a cross-sectional end view of a welded purlin brace system having a channel strut.
Figure 6B:
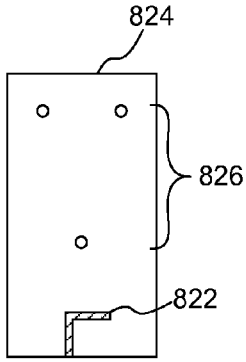
FIG. 6B is a cross-sectional end view of a welded purlin brace system having an angle strut.
Figure 6C:
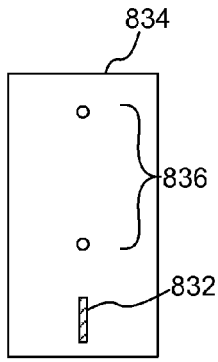
FIG. 6C is a cross-sectional end view of a welded purlin brace system having a vertical flat plate strut.
Figure 6D:
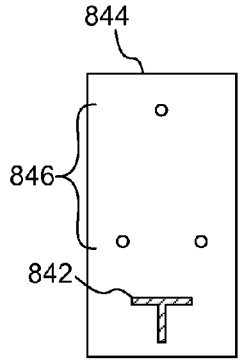
FIG. 6D is a cross-sectional end view of a welded purlin brace system having a T-bar strut.

FIG. 6A shows a span member 812 having a channel or U-shaped cross-section. The vertical plate 814 can have a bolt hole pattern 816 for attachment to a purlin. In this case, the bolt hole pattern 816 can accommodate four bolts or screws in a rectangular arrangement. FIG. 6B shows a span member 822 having a flat plate cross-section oriented vertically. The vertical plate 824 can have a bolt hole pattern 826 for attachment to a purlin. In this case, the bolt hole pattern 826 can accommodate two bolts or screws in a vertical arrangement. FIG. 6C shows a span member 832 having an angled or L-shaped cross-section. The vertical plate 834 can have a bolt hole pattern 836 for attachment to a purlin. In this case, the bolt hole pattern 836 can accommodate three bolts or screws in an inverted triangle arrangement. FIG. 6D shows a span member 842 having a T-shaped cross-section. The vertical plate 844 can have a bolt hole pattern 846 for attachment to a purlin. In this case, the bolt hole pattern 846 can accommodate three bolts or screws in a triangle arrangement. It should be recognized from these examples, that the bolt hole pattern and the number of fasteners can vary so long as the bolt hole arrangement allows a sufficiently strong coupling to the purlin web.

Figure 6E:
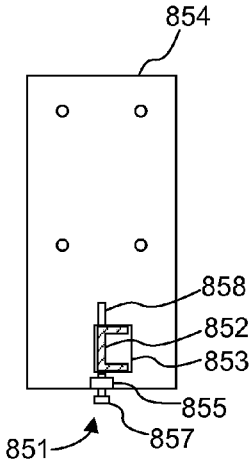
FIG. 6E is a cross-sectional end view of a bolted purlin brace system having a channel strut.

FIGS. 6E-6H illustrate the various span member cross-sections discussed above with respect to FIGS. 6A-6D in a threaded engagement with a vertical plate. For example, FIG. 6E shows a span member 852 having a channel or U-shaped cross-section attached to vertical plate 854 with a threaded engagement 851. The vertical plate 854 includes an opening 853 to allow the span member 852 to pass through the vertical plate 854. In this case, the opening 853 is rectangular shaped and does not match the cross-sectional shape of the span member 852. A spacer member 858 is attached to the vertical plate to align with the opening 853 in order to contact the span member 852 when the threaded engagement 851 attaches the span member 852 to the vertical plate 854. The spacer member 858 can extend from one or both sides of the vertical plate 854.

The threaded engagement 851 includes a tab 855 that can include threads to engage a bolt or screw 857. To attach the span member 852 to the vertical plate 854, the span member 852 can be appropriately positioned relative to the vertical plate 854 within the opening 853. The bolt 857 can then be advanced toward the span member 852 until a sufficient load is placed on the span member 852 and the vertical plate 854 to prevent relative movement between the span member 852 and the vertical plate 854 when installed and serving as a purlin brace. In another aspect, instead of a tab, the vertical plate itself can include a threaded hole to receive and engage a bolt or screw for the threaded engagement.

Figure 6F:
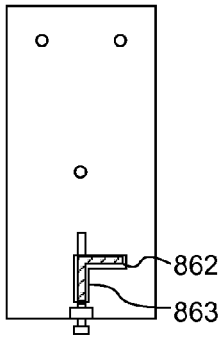
FIG. 6F is a cross-sectional view of a bolted purlin brace system having an angle strut.
Figure 6G:
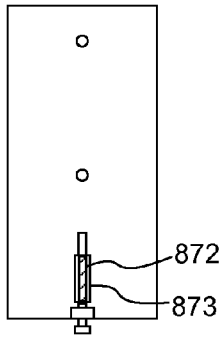
FIG. 6G is a cross-sectional view of a bolted purlin brace system having a vertical flat plate strut.
Figure 6H:
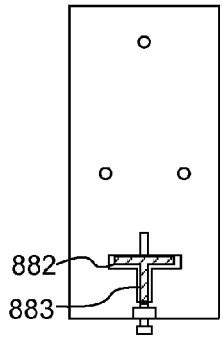
FIG. 6H is a cross-sectional view of a bolted purlin brace system having a T-bar strut.

FIGS. 6F-6H illustrate examples of a threaded engagement, discussed above relative to FIG. 6E, for other span member cross-sectional shapes. The same principles apply to these span member cross-sectional shapes, as well. Unlike the opening 853 in FIG. 6E, however, openings 863, 873, and 883 are similar in shape to the cross-sectional shape of span members 862, 872, and 882. Thus, the openings for a span member can be any suitable size or shape in accordance with the present disclosure. As shown in the figures, the application of force by the threaded engagement is directed to a portion of the span member that is able to withstand a large compressive load without failing. The arrangements shown, however, are for illustration only as many other suitable threaded engagement arrangements are possible within the scope of the present disclosure.

Figure 7:
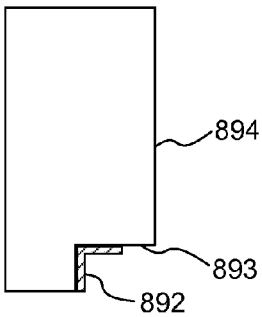
FIG. 7 is a cross-sectional end view of another example of a welded purlin brace system having an angle strut.

FIG. 7 illustrates yet another example of a welded joint between a vertical plate 894 and a span member 892. In this example, the vertical plate 894 includes an opening 893 that accommodates the cross-section angled or L-shaped span member 892. The span member can be welded to the vertical plate at the opening. The span member can extend beyond the vertical plate or it can terminate at the vertical plate. This example also illustrates that the vertical plate need not include any holes for fasteners to the purlin. In one aspect, the vertical plate can be fastened to the purlin using self-tapping screws. In another aspect, the vertical plate can be fastened to the purlin by welding. In yet another aspect, the vertical plate need not be fastened to the purlin. In this case, the purlin brace can be secured to the purlin via the span member. Even thought the vertical plate is not directly fastened to the purlin in this aspect, the vertical plate can still contribute to the structural reinforcement of the purlins and prevent movement of the purlins.

FIGS. 5A-5D, 6A-6H, and 7, taken together, also illustrate a fastening region of the vertical plates to the purlins. As seen in the figures, the vertical plates can extend past, or from, the span members to be secured to the purlins. This extension of the vertical plates allows for a coupling with the purlins sufficient to provide stability to the purlins via the purlin brace. In one aspect, a vertical plate may extend past, or from, the span member an extension distance from two to eight times a width of the span member. In a particular aspect, the vertical plate may extend past, or from, the span member an extension distance from three to five times a width of the span member.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. A purlin brace system for roof decks, comprising:

a. a plurality of purlins, each purlin including a central support and a bottom flange, said plurality of purlins oriented to form a parallel array of purlins such that voids exist between the purlins in the parallel array, the bottom flanges defining a lower plane;

b. at least one brace oriented transverse to the plurality of purlins, said at least one brace having a span member transverse to a purlin axis, and at least two vertical plates secured to at least two of the plurality of purlins along the central supports, respectively, and cantilevered from and attached directly to the span member such that the at least two vertical plates extend substantially perpendicularly away from the span member and along the central supports to resist rotational movement of the corresponding purlins and minimize interruption of the voids.

2. The system of claim 1, wherein the purlins are Z-purlins.

3. The system of claim 1, wherein the purlins are metal purlins.

4. The system of claim 1, wherein the voids are substantially uninterrupted along the purlin axis.

5. The system of claim 1, further comprising insulation disposed within the voids.

6. The system of claim 5, wherein the insulation is substantially continuous along the purlin axis.

7. The system of claim 1, wherein the at least one brace is secured to at least one of the plurality of purlins along the bottom flange via the span member.

8. The system of claim 1, wherein the at least one brace is secured to at least one of the plurality of purlins along an upper flange.

9. The system of claim 1, wherein the at least one brace spans at least three purlins.

10. The system of claim 1, wherein the span member is disposed below the lower plane.

11. The system of claim 10, wherein the at least one brace further comprises a spacer member oriented to contact the bottom flange and maintain a gap between the bottom flange and the span member.

12. The system of claim 1, wherein the span member is disposed above the lower plane adjacent the bottom flange or adjacent an upper flange of the purlin.

13. The system of claim 12, further comprising a facing member attached to the parallel array of purlins along the lower plane.

14. The system of claim 1, wherein the span member is a rectangular bar, angle, channel, or T-bar.

15. The system of claim 12, wherein the span member is a rectangular bar.

16. The system of claim 1, wherein the vertical plate is attached to the span member via a welded joint.

17. The system of claim 1, wherein the vertical plate is attached to the span member via an adjustable threaded engagement.

18. The system of claim 1, wherein the vertical plate includes a slot configured to receive the span member which is attached therein.

19. The system of claim 1, wherein the vertical plate extends past the span member an extension distance from two to eight times a width of the span member.

20. The system of claim 1, wherein the span member, vertical plate and purlin axes are each orthogonal to the other.

21. The system of claim 1, further comprising a plurality of metal roof panels, each panel being configured to be attached to an upper flange of the metal purlins to form a roof deck.

22. The system of claim 21, further comprising a plurality of thermal insulation blocks, each thermal insulation block being disposed between the metal purlin and the metal roof panel.

23. The system of claim 22, further comprising a cleat disposed between the thermal insulation block and the metal roof panel, wherein the cleat includes a protrusion which secures the thermal insulation block and inhibits lateral movement between the thermal insulation block and the cleat.

24. The system of claim 1, wherein the vertical plate is in contact with and secured to the central support to resist rotational movement of a corresponding purlin.

* * * * *